US008331832B2

(12) United States Patent
Ikeda et al.

(10) Patent No.: US 8,331,832 B2
(45) Date of Patent: Dec. 11, 2012

(54) DEVELOPING DEVICE, ASSEMBLY BODY, AND IMAGE FORMING APPARATUS

(75) Inventors: Miho Ikeda, Kanagawa (JP); Makoto Hirota, Kanagawa (JP); Jun Abe, Kanagawa (JP); Shota Oba, Kanagawa (JP); Takashi Ochi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 293 days.

(21) Appl. No.: 12/875,598

(22) Filed: Sep. 3, 2010

(65) Prior Publication Data

US 2011/0222918 A1 Sep. 15, 2011

(30) Foreign Application Priority Data

Mar. 15, 2010 (JP) ..... 2010-057687

(51) Int. Cl.
*G03G 15/09* (2006.01)

(52) U.S. Cl. ..... 399/269

(58) Field of Classification Search ..... 399/267, 399/269, 273, 274, 275, 277
See application file for complete search history.

(56) References Cited

U.S. PATENT DOCUMENTS

| | | | | |
|---|---|---|---|---|
| 6,813,462 | B2 * | 11/2004 | Mitsuya et al. | 399/269 |
| 7,466,946 | B2 * | 12/2008 | Tsujita et al. | 399/269 |
| 2006/0216069 | A1 | 9/2006 | Tsujita et al. | |

FOREIGN PATENT DOCUMENTS

| | | |
|---|---|---|
| JP | A-2006-47840 | 2/2006 |
| JP | A-2006-267891 | 10/2006 |
| JP | A-2007-47640 | 2/2007 |
| JP | A-2007-164066 | 6/2007 |

* cited by examiner

*Primary Examiner* — Hoang Ngo
(74) *Attorney, Agent, or Firm* — Oliff & Berridge, PLC

(57) ABSTRACT

A developing device includes: a first-developer-holding-member facing a surface of a rotating latent image carrier, it rotating such that a moving direction thereof is opposite to that of the carrier at a portion where they face; a second-developer-holding-member provided at a downstream-side of the first-developer-holding-member in a direction in which the carrier rotates, and facing the surface of the carrier, it rotating such that a moving direction thereof is the same as that of the carrier at a portion where they face; a ratio of circumferential speeds of the first-developer-holding-member and the second-developer-holding-member being variable; a splitting member that splits a developer for the first-developer-holding-member and the second-developer-holding-member by hitting against the developer located between the first-developer-holding-member and the second-developer-holding-member; a moving unit that moves the splitting member; and a control unit that controls the moving unit to move the splitting member to vary split ratio of the developer.

20 Claims, 7 Drawing Sheets

DEVELOPING DEVICE, ASSEMBLY BODY, AND IMAGE FORMING APPARATUS

CROSS-REFERENCE TO RELATED APPLICATION

This application is based on and claims priority under 35 USC 119 from Japanese Patent Application No. 2010-57687 filed on Mar. 15, 2010.

BACKGROUND

1. Technical Field

The present invention relates to a developing device, an assembly body and an image forming apparatus.

2. Related Art

SUMMARY

A developing device according to an aspect of the invention includes: a first developer holding member that is disposed to face a surface of a latent image carrier that rotates, the first developer holding member rotating such that a moving direction of the first developer holding member is opposite to that of the latent image carrier at a portion where the latent image carrier and the first developer holding member face each other; a second developer holding member that is provided at a downstream side of the first developer holding member in a direction in which the latent image carrier rotates, and is disposed to face the surface of the latent image carrier, the second developer holding member rotating such that a moving direction of the second developer holding member is the same as that of the latent image carrier at a portion where the latent image carrier and the second developer holding member face each other, and a ratio of circumferential speeds of the first developer holding member and the second developer holding member being variable; a splitting member that splits developer for the first developer holding member and the second developer holding member at a position between the first developer holding member and the second developer holding member, by hitting against the developer located between a surface of the first developer holding member and a surface of the second developer holding member; a moving unit that moves the splitting member; and a control unit that controls the moving unit to move the splitting member so as to vary a split ratio of the developer.

BRIEF DESCRIPTION OF THE DRAWINGS

Exemplary embodiments of the invention will be described in detail with reference to the following figures, wherein.

DETAILED DESCRIPTION

One example of each of a developing device, an assembly body and an image forming apparatus according to a first exemplary embodiment of the present invention is described with reference to FIGS. 1 through 5. Note that arrow UP shown in these drawings indicates an upper side in the vertical direction.

(Overall Structure)

Figure 5:
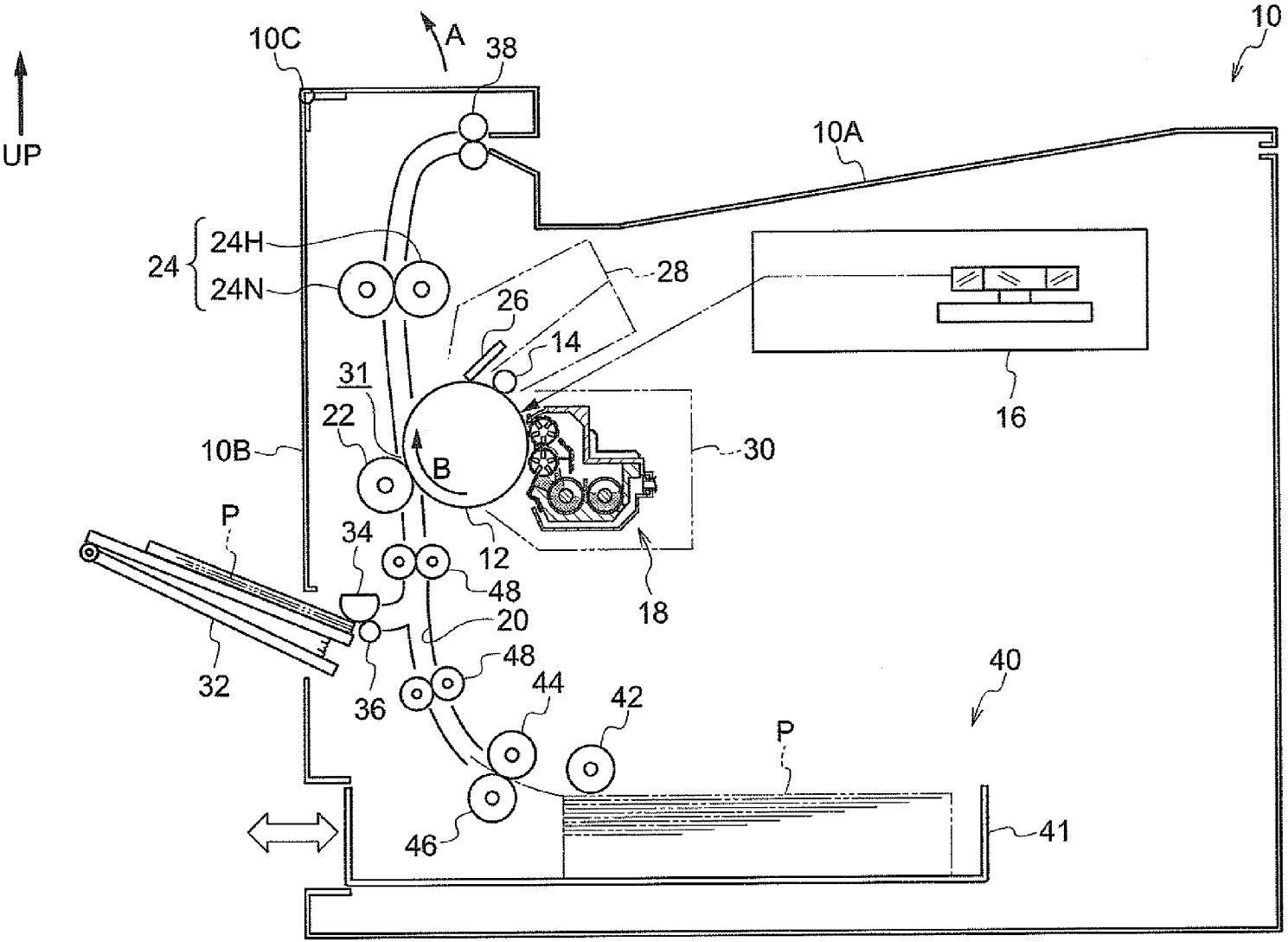
FIG. 5 is a schematic structural view showing an image forming apparatus, an assembly body and the like according to a first exemplary embodiment of the present invention.

As shown in FIG. 5, an image forming apparatus 10 includes: a latent image carrier 12 which is electric-charged evenly, and thereafter, causes an electrostatic latent image to be formed on a surface thereof by being irradiated with laser light; a charging device 14 which electric-charges the surface of the latent image carrier 12 evenly; an exposure device 16 in which the latent image carrier 12 is irradiated with laser light based on image data, so as to form an electrostatic latent image; and a developing device 18 in which a toner is selectively transferred to the electrostatic latent image and a latent image is made visible as a toner image; a transfer roll 22 which transfers the toner image on the surface of the latent image carrier 12 to a sheet member P serving as a recording medium supplied along a transport path 20; a fixing device 24 in which the toner image on the sheet member P is heated and pressurized, and fixed on the sheet member P; and a cleaning device 26 which cleans a toner remaining on the latent image carrier 12 after the toner image is transferred. The developing device 18 is described later in details.

Further, the image forming apparatus 10 is covered by a main body side surface cover 1013 and a top plate 10A. A shaft 10C is provided at an upper end corner portion of the main body side surface cover 1013 and connects the top plate 10A to the main body side surface cover 10B in a rotatable manner. By the top plate 10A being rotated around the shaft 10C in the direction indicated by arrow A, the inside of the image forming apparatus 10 is opened.

Here, the charging device 14 and the cleaning device 26 are formed as one charging unit 28, and the developing device 18 and the latent image carrier 12, each provided as an assembly body, are formed as an exchangeable cartridge 30. With the top plate 10A of the image forming apparatus 10 being opened, the charging unit 28 and the exchangeable cartridge 30 are each attachable/removable with respect to a main body frame (not shown) inside of the image forming apparatus 10.

Further, a manual paper feed pedestal 32 is provided at the side of the image forming apparatus 10 and allows manual feeding of the sheet member P to an image forming portion 31 formed by the latent image carrier 12 and the transfer roll 22. The manual paper feed pedestal 32 is provided with a delivery roll 34 having a half-moon-shaped configuration. In addition, a separating roll 36 is provided with respect to the delivery roll 34 with the sheet member P interposed therebetween.

The separation roll 36 is axially supported by supporting members (not shown) provided at both end portions thereof, and is urged by means of urging force of coil springs provided within the supporting members, toward the delivery roll 34. Due to the above-described structure, when the delivery roll 34 rotates, the sheet members P placed on the manual paper feed pedestal 32 are fed one by one to the image forming portion 31 by the delivery roll 34 and the separation roll 36.

Moreover, a paper feed device 40 which feeds the sheet members P one by one is provided at the lower side within the image forming apparatus 10. The paper feed device 40 is provided with a paper feed member 41 in which plural sheet members P are superimposed, and has a structure in which the sheet members P stacked in the paper feed member 41 are sequentially taken out by a take-off roll 42 and are transported one by one by a paper feed roll 44 driven to rotate and a separating roll 46 provided in the paper feed member 41.

Plural transport rolls 48 are provided along the transport path 20 of the sheet member P, and the sheet member P is transported to the downstream side in the transport direction of the sheet member P along the transport path 20.

The above-described fixing device 24 is provided at the downstream side of the image forming section 31. The fixing device 24 includes a heating roll 24H and a pressure applying roll 24N. Due to the sheet member P passing through between the heating roll 24H and the pressure applying roll 24N, the toner image on the sheet member P is fixed on the sheet member P.

Further, an exhaust roll 38 is provided at the downstream side of the fixing device 24 and discharges the sheet member P having the toner image fixed thereon to the upper surface of the top plate 10A.

In the image forming apparatus 10 having the above-described structure, an image is formed in such a manner as described below.

First, the charging device 14 to which a voltage is applied charges negative the surface of the latent image carrier 12 at an intended potential with uniformity. Subsequently, based on image data read by a scanner (not shown) or data input form outside, the charged surface of the latent image carrier 12 is exposed by the exposure device 16, and an electrostatic latent image is formed on the surface of the latent image carrier 12.

In other words, based on video data supplied from a control device (not shown), laser of the exposure device 16 is switched on or off, whereby an electrostatic latent image corresponding to image data is formed on the latent image carrier 12. Further, this electrostatic latent image is made visible as a toner image by the toner supplied from the developing device 18.

Consequentially, the sheet member P taken out from the paper feed member 41 by the take-off roll 42 is sent, by the paper feed roll 44 and the separating roll 46, to the transport roll 48 one by one and is delivered to the transport path 20. The sheet member P delivered to the transport path 20 passes through the image forming portion 31 formed between the latent image carrier 12 and the transfer roll 22, and the toner image is transferred to the sheet member P. The transferred toner image is fixed on the sheet member P by passing through between the heating roll 24H and the pressure applying roll 24N, and is discharged by the exhaust roll 38 to the upper surface of the top plate 10A.

Incidentally, in the image forming apparatus 10 of the present exemplary embodiment, one developing device 18 is provided, but in a case in which a color image is formed, developing devices 18 corresponding to four colors of yellow (Y), magenta (M), cyan (C), and black (K) are disposed at positions each facing the latent image carrier 12.

(Structure of Main Part)

Next, the structure of the developing device 18 is described.

Figure 2:
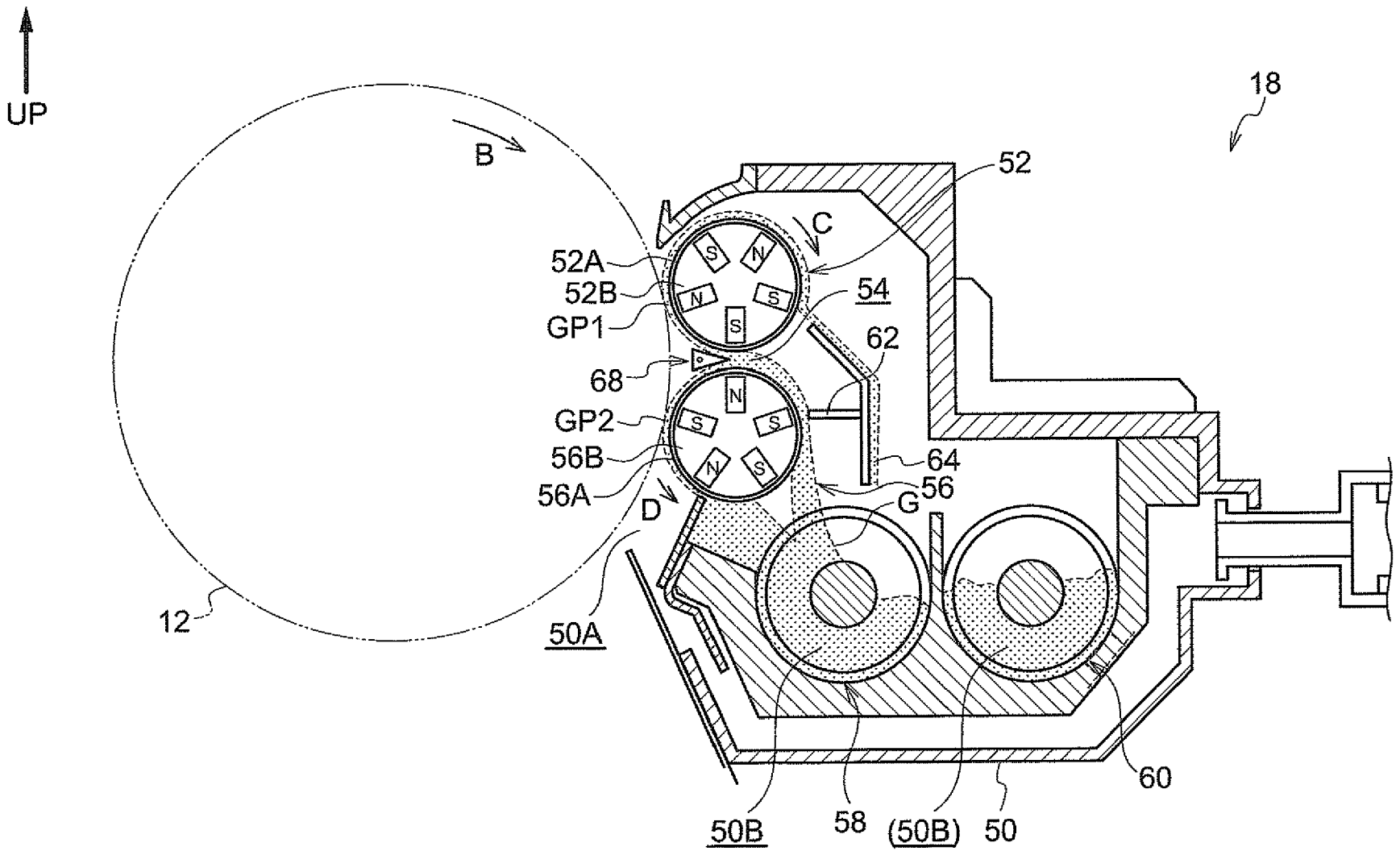
FIG. 2 is a side view showing a developing device according to a first exemplary embodiment of the present invention.

As shown in FIG. 2, the developing device 18 is provided with a case body 50 having an opening portion 50A at a position which faces the latent image carrier 12. A first development roll 52, which is an example of a first developer holing member, is accommodated in the case body 50. The first development roll 52 is disposed to face the surface (the outer peripheral surface) of the latent image carrier 12. The first development roll 52 rotates in the same direction as the rotating direction of the latent image carrier 12 rotating in the direction indicated by arrow B, that is, a direction in which the first development roll 52 moves in a development nip GP1 which faces the latent image carrier 12 is opposite to a direction in which the latent image carrier 12 moves thereat (that is, a direction indicated by arrow C). The first development roll 52 holds a developer G on the surface (the outer peripheral surface) thereof, Further, a second development roll 56, which is an example of a second developer holding member, is also accommodated in the case body 50 below the first development roll 52. The second development roll 56 is disposed to face the surface of the latent image carrier 12. The second development roll 56 rotates in a direction opposite to the rotating direction of the latent image carrier 12, that is, a direction in which the second development roll 56 moves in a development nip GP2 which faces the latent image carrier 12 is the same as the direction in which the latent image carrier 12 moves thereat (i.e., the direction indicated by arrow D). The second development roll 56 holds the developer G on the surface (outer peripheral surface) thereof.

In addition, a first agitation-transport auger 58 and a second agitation-transport auger 60, which are arranged in lined up manner and transport the developer G to the second development roll 56, are provided in an accommodation chamber 50B, provided at the lower side within the case body 50, which accommodates the developer G therein.

The first agitation-transport auger 58 and the second agitation-transport auger 60 are arranged in lined up manner at the lower side of the second development roll 56 (at the lower right side of the figure) so as to circulate and transport the developer G. By the first agitation-transport auger 58 and the second agitation-transport auger 60 rotating, the developer G is transported along a rotation-axis direction of the second development roll 56 while being agitated. Thus, the developer G is supplied to the second development roll 56. The developer G used in the developing device 18 contains a toner made from resin, and magnetic carrier particles, as principal components thereof.

Further, the first development roll 52 provided above the second development roll 56 is disposed so as to face the surface of the latent image carrier 12 such that the rotation-axis direction of the first development roll 52 is set along the rotation-axis direction of the latent image carrier 12. The first development roll 52 includes a tube-shaped first development sleeve 52A and a circular column-shaped first magnet roll 52B. A direction in which the tube-shaped first development sleeve 52A moves in the development nip GP1 which faces the latent image carrier 12 is opposite to a direction in which the latent image carrier 12 moves thereat. The circular column-shaped first magnet roll 52B is disposed inside of the first development sleeve 52A and forms magnetic field so as to be distributed at the outer side of the first development sleeve 52A in the circumferential direction. As a result, the first development roll 52 causes a toner to be developed by an electric field on a latent image of the latent image carrier 12 in the development nip GP1 facing the latent image carrier 12.

The circumferential speed of the first development sleeve 52A can be varied. In the present exemplary embodiment, for the purpose of improving development properties, the circumferential speed of the first development roll 52 is determined such that the circumferential speed ratio of the first development roll 52 (the first development sleeve 52A) with respect to the latent image carrier 12 is set in the range of 0.7 to 2.0.

The second development sleeve 56A is disposed so as to face the surface of the latent image carrier 12 at the downstream side of the first development roll 52 in the direction in which the latent image carrier 12 rotates, such that the rotation-axis direction thereof is set along the rotation-axis direction of the latent image carrier 12. The second development roll 56 includes a tube-shaped second development sleeve 56A and a circular column-shaped second magnet roll 56B. A direction in which the second development sleeve 56A moves in the development nip GP2 facing the latent image carrier 12 is the same as the direction in which the latent image carrier 12 moves thereat. The second magnet roll 56B is disposed inside of the second development sleeve 56A and forms magnetic fields so as to be distributed in the circumferential direction at the outer side of the second development sleeve 56A. As a result, the second development roll 56 causes a toner to be developed by an electric field on a latent image of the latent image carrier 12 in the development nip GP2 facing the latent image carrier 12.

The circumferential speed of the second development sleeve 56A can be varied. In the present exemplary embodiment, in order to adjust image quality, the circumferential speed of the second development roll 56 is determined such that the circumferential speed ratio of the second development roll 56 (the second development sleeve 56A) with respect to the latent image carrier 12 is set in the range of 1.0 to 2.5.

The first development roll 52 and the second development roll 56 are disposed to face each other such that a clearance is formed between the outer periphery of the first development sleeve 52A and the outer periphery of the second development sleeve 56A. A delivery portion 54 in which delivery of the developer G held on the surface of the second development sleeve 56A and transported is performed is formed between the first development sleeve 52A and the second development sleeve 56A (in a minimum clearance portion).

Further, a layer forming member 62 is disposed at the upstream side of the delivery portion 54 in the direction in which the second development roll 56 rotates. The layer forming member 62 faces the surface of the second development roll 56, and allows adhesion of a proper amount of developer and flattens uniformly a developer layer in the axial direction. The layer forming member 62 is made from a plate material having a rectangular cross section taken along the normal-line direction of the outer periphery of the second development roll 56. One side surface of the rectangular section of the layer forming member 62 is disposed so as to face the surface of the second development roll 56 and the other side surface is fixed to a guide plate 64 provided within the case body 50.

The guide plate 64 is provided such that the leading end portion thereof is disposed so as to face the first development roll 52 and the other end portion extends down toward the first agitation-transport auger 58. The guide plate 64 is configured so as to drop down the developer G dropping out of the first development roll 52 toward the accommodation chamber 50B. In other words, the developer G dropping out of the first development roll 52 drops down toward the accommodation chamber 50B without immediately adhering again to the second development roll 56, and is agitated with the developer in the developer accommodation chamber.

Figure 1:
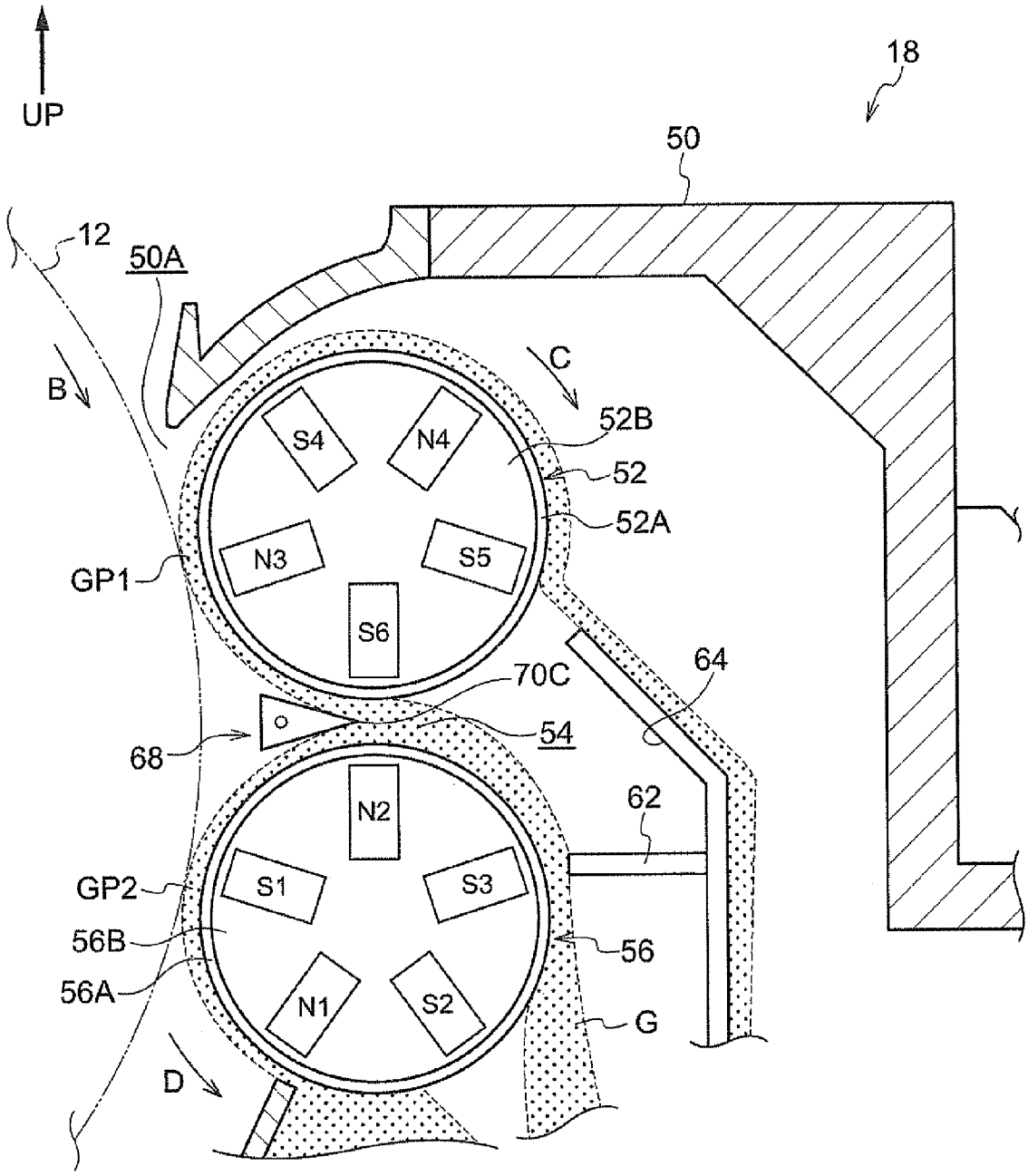
FIG. 1 is a side view showing developing rolls, a separating member and the like of a developing device according to a first exemplary embodiment of the present invention.

As shown in FIG. 1, five permanent magnets each having an S-pole or an N-pole formed on the surface side thereof are provided inside of the second magnet roll 56B and are disposed in a radial pattern along the circumferential direction of the second development sleeve 56A. The pole S1 which is a development pole is disposed at a position facing the latent image carrier 12. Further, a transport pole N1 is disposed adjacent to the development pole S1 in the rotating direction of the second development sleeve 56A indicated by arrow D, and a pickoff pole S2 adjacent to the transport pole N1, a pickup pole S3, and a transport pole N2 are disposed in this order.

Five permanent magnets each having an S-pole or an N-pole formed on the surface side thereof are provided inside of the first magnet roll 52B and are disposed in a radial pattern along the circumferential direction of the first development sleeve 52A. The pole N3 which is a development pole is disposed at a position facing the latent image carrier 12. Further, transport poles S4, N4 are sequentially disposed adjacent to the development pole N3 in the rotation direction of the first development sleeve 52A indicated by arrow C, and a pickoff pole S5 is disposed adjacent to the pole N4. Disposed adjacent to the pickoff pole S5 is an opposing pole S6 which faces the transport pole N2 provided in the second magnet roll 5613.

A separating member (splitting member) 68 is provided at the downstream side of the delivery portion 54 in the rotating direction of the first development roll 52 so as to extend along the longitudinal direction of the first development roll 52. The separating member 68 hits against the developer G adhering to the second development roll 56 and separates (splits) the developer G for the first development roll 52 and the second development roll 56.

Figure 3:
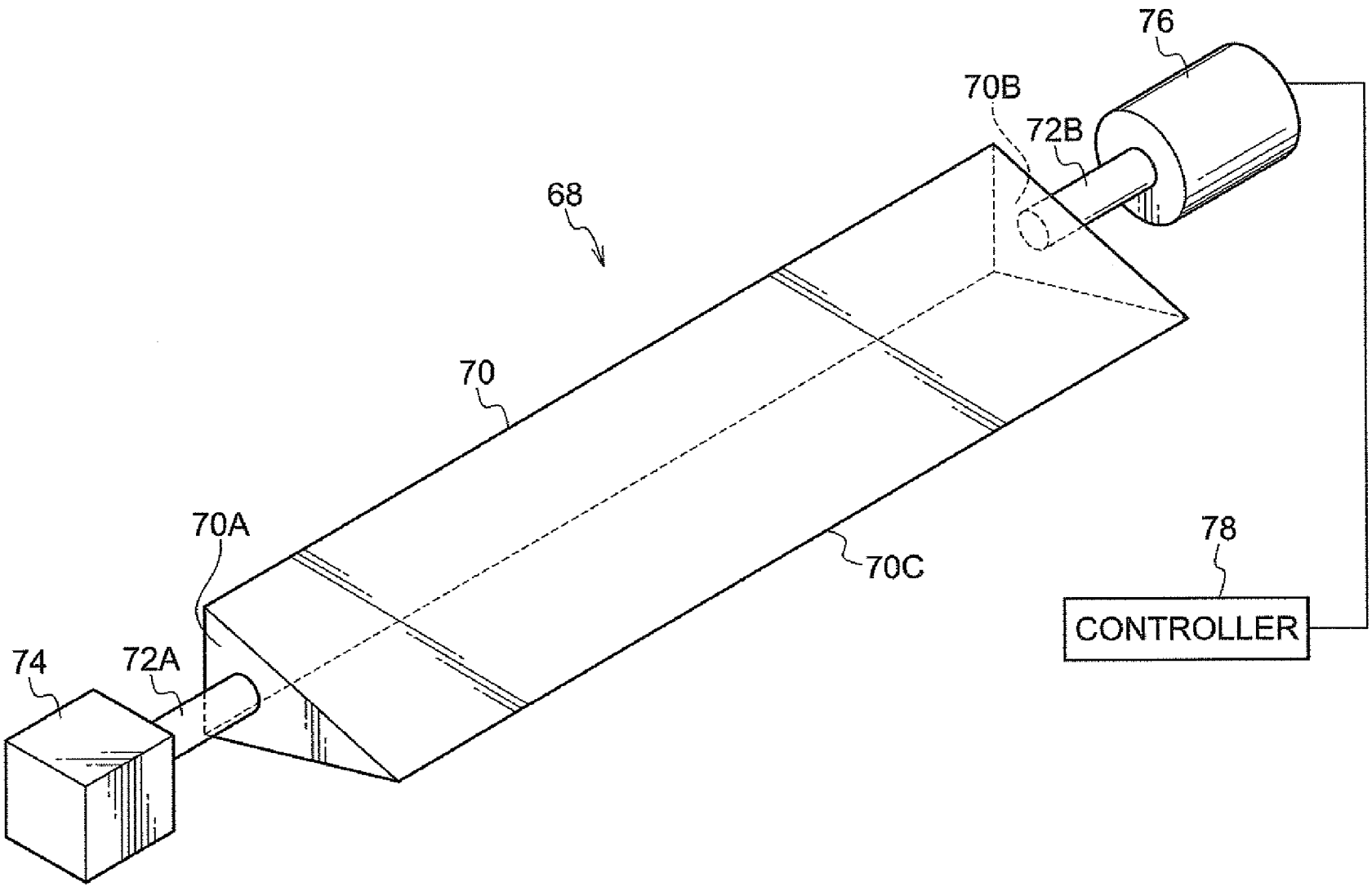
FIG. 3 is a perspective view showing a separating member and the like used in a developing device according to a first exemplary embodiment of the present invention.

As shown in FIG. 3, the separating member 68 has an acute angled isosceles triangle-shaped cross section, and includes a separating portion (split portion) 70 and a shaft portion 72. The separating portion 70 separates the developer G by an acute angled leading end 70C hitting against the developer G (see FIG. 1). The shaft portion 72 rotates integrally with the separating portion 70. The shaft portion 72 is formed so as to project from each of both end surfaces in the longitudinal direction of the separating portion 70. One shaft portion 72A projecting from one end surface 70A is supported rotatably by a bracket 74 fixed to the case body 50 (see FIG. 2), and the other shaft portion 72B projecting from the other end surface 70B is fixed to an output shaft of a stepping motor 76 which is an example of a moving unit supported by the case body 50.

Further, the stepping motor 76 is provided with a controller 78 which is an example of a control unit which controls the rotation angle of the stepping motor 76 to rotate and move the separating portion 70 so as to change the separation ratio (split ratio) of the developer G.

(Operation)

An electrostatic latent image on the latent image carrier 12 is, first, developed by the first development roll 52 moving in the direction opposite to the moving direction of the latent image carrier at the development nip GP1, and thereafter, is further developed by the second development roll 56 moving in the same direction as the moving direction of the latent image carrier at the development nip GP2, whereby a toner image is formed.

The flow of the developer is reverse. First, a developer layer is formed on the second development roll 56, and thereafter, a part of the developer G is transferred by the separating member 68 to the first development roll 52.

A detailed description is given below for the flow of the developer G.

As shown in FIG. 1 and FIG. 2, in the developing device 18, the developer G adheres to the surface of the second development sleeve 56A from the first agitation-transport auger 58 by the pickup pole S3, and is divided into a proper amount between the first development roll 52 and the second development roll 56 by the separating member 68 disposed in the vicinity of the transport pole N2, and thereafter, the divided developer is transported to the development pole S1, transport pole N1 and pickoff pole S2 along the rotating direction D. A toner on a magnetic brush in the vicinity of the development pole S1 is moved to the latent image carrier 12, and an electrostatic latent image formed on the late image carrier 12 is made visible. The second development roll 56 moves in the same direction with respect to the latent image carrier 12 in the development nip GP2 facing the latent image carrier 12, and therefore, the relative speed of the second development roll is small so rubbing-frictional force by the magnetic brush on the development roll 56 for a toner image can be reduced. Thus, an image quality having excellent graininess is obtained. Accordingly, microscopic non-uniformity of an image formed by the first development roll 52 disposed at the upstream side is corrected and an output image having a higher image quality is obtained.

In the vicinity of the pickoff pole S2, the developer G drops down from the surface of the second development sleeve 56A so as to back to the accommodation chamber 50B.

The developer G separated to the first development roll 52 by the separating member 68 in the delivery portion 54 is transported sequentially to the opposing pole Sb, the development pole N3, the transport pole S4, the transport pole N4, and the pickoff pole S5 along the surface of the first development sleeve 52A, with accompanied by the first development sleeve 52A rotating along the rotating direction indicated by arrow C. In the vicinity of the development pole N3, a toner on a magnetic brush moves to the latent image carrier 12. The first development roll 52 moves in the opposite direction with respect to the latent image carrier 12 in the development gap GP1 facing the latent image carrier 12, and therefore, the relative speed of the first development roll becomes large so there is an advantage that a high amount of development can be performed in even at a low rotational speed.

Accordingly, a more stabilized image quality can be obtained by performing control such that an amount of development required for obtaining image density is principally secured by the first development roll 52.

Further, in the vicinity of the pickoff pole 85, the developer G drops down from the surface of the first development sleeve 52A and is guided by the guide plate 64, and is placed back to the accommodation chamber 50B.

Specifically, the developer G passes by the pickup pole S3 of the second development roll 56, and thereafter, a layer of the developer with an amount sufficient for carrying out development by the two development rolls is formed by the layer forming member 62 uniformly in the axial direction.

Then, the developer G transported to the delivery section 54 hits against the separating member 68, and a part of the developer is delivered (separated) from the second development roll 56 to the first development roll 52.

Here, the transport pole N2 of the second development roll 56 and the opposing pole S6 of the first development roll 52, which face each other in the delivery portion 54, have different polarities, and therefore, magnetic brush of the developer G is formed in the delivery portion 54. Accordingly, the developer G hits against the leading end 70C (a peak point of the isosceles triangle) of the separating portion 70 so that the developer G can be separated into the first development roll 52 and the second development roll 56 without applying a large pressure to the developer G. Thus, as compared to a conventional method in which a layer regulating member is used for each of two development rolls, deterioration of the developer can be alleviated.

In this case, the separation ratio of the developer G to the first development roll 52 or the second development roll 56 is determined based on a position at which the leading end of the separating member 68 supported in rotatable and movable is stopped, and the ratio of circumferential speeds of the two development rolls.

Figure 4A:
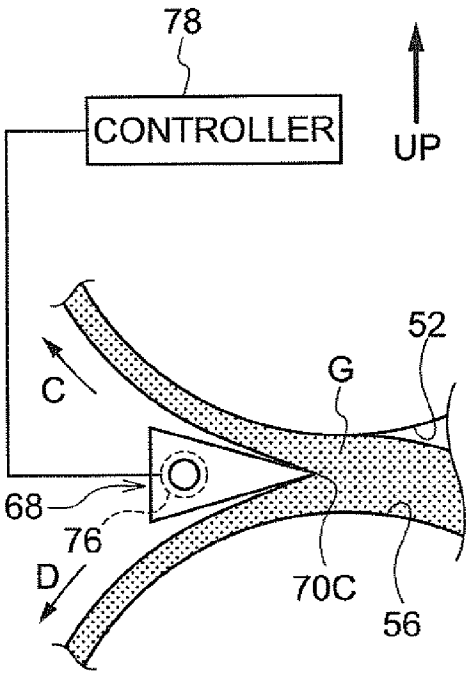
FIGS. 4A, 4B and 4C are side views each showing a separating member used in a developing device according to a first exemplary embodiment of the present invention.

As shown in FIG. 4A, in a case in which the ratio of circumferential speeds of the second development roll 56 and the first development roll 52 is 1, and the amount of developer per unit area, adhering to the second development roll 56, and the amount of developer per unit area, adhering to the first development roll 52 is made equal to each other, the controller 78 rotates and moves the separating member 68 such that a distance between the leading end 70C of the separating portion 70 and the surface of the first development roll 52 and a distance between the leading end 70C and the surface of the second development roll 56 substantially become equal to each other.

In a case in which the development property may be deteriorated depending on the environment, passage of time, use conditions, and the like, it is necessary to ensure the development property by increasing the circumferential speed of the first development roll 52.

In this case, the amount of the developer transported by the second development roll 56 to the separating member 68 per unit area and per unit time is constant. However, the amount of developer transported to the first development roll 52 whose circumferential speed per unit time is increased. As a result, the amount of developer on the development roll 56 per unit area decreases. Accordingly, there are cases that a carrier of the developer G may transfer to the latent image carrier 12 so as to cause a failure in an output image, blur may occur due to decreasing in image correction effect, and deterioration of graininess may occur.

Figure 4B:
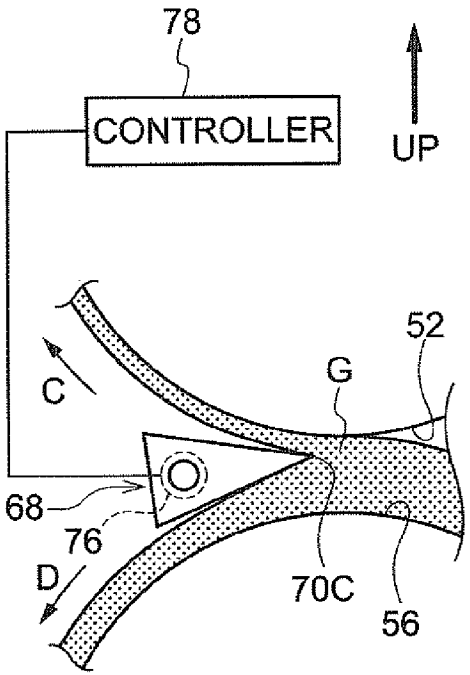

However, as shown in FIG. 4B, the controller 78 activates the stepping motor 76 to rotate and move the separating member 68, whereby at least the minimum amount of the developer G transported by the second development roll 56 is maintained (secured), and the above-described defects do not occur.

In regard to the development property, the sensitivity for the amount of developer per unit time, which developer passes through the development nip GP1, (i.e., the sensitivity with respect to the circumferential speed) is higher than that for the amount of developer per unit area on the development roll. Therefore, even though the amount of developer adhering to the first development roll 52 decreases, no problem occurs in the development property.

Further, even though carrier transfer or blur occur in the first development roll 52, at the second development roll which is at the downstream side, collecting of carrier and correcting of an image are performed, so not leading to occurrence of any problem.

To the contrary, in a case in which the development property of the first development roll 52 becomes too high due to the environment, passage of time, use conditions, so that the image correcting effect in the second development roll 56 becomes small or lost, the circumferential speed of the first development roll 52 needs to be decreased. In this case, the amount of developer on the second development roll 56 per unit area increases, so there are cases that clogging of developer in the development nip may occur, rubbing may occur, and deterioration of graininess may occur.

Figure 4C:
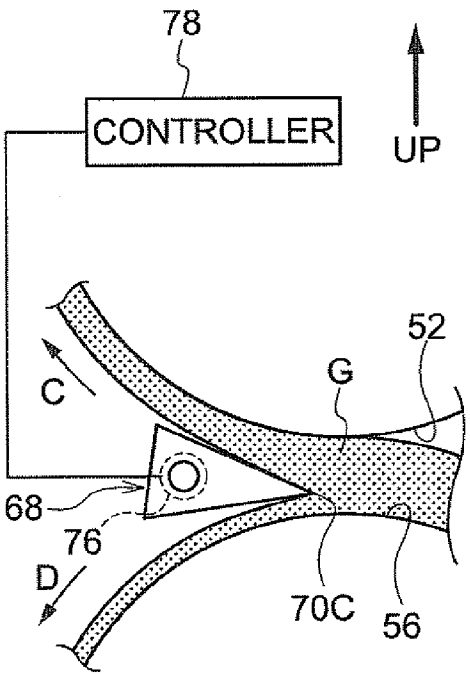

However, as shown in FIG. 4C, the controller 78 activates the stepping motor 76 to rotate and move the separation member 68, thereby making it possible to reduce the amount of the developer adhering to the surface of the second development roll 56 to an extent where there is no problem.

In more detail, in a case in which the circumferential speed of the first developer roll 52 is made increased, as shown in FIG. 4B, the controller 78 controls so that the leading end 70C of the separating member 68 is moved to approach toward (close to) the first developer roll 52 whose circumferential speed is relatively increased, that is, the leading end 70C of the separating member 68 is moved away from the second developer roll 56 whose circumferential speed is relatively decreased.

On the other hand, in a case in which the circumferential speed of the first developer roll 52 is made decreased, as shown in FIG. 4C, the controller 78 controls so that the leading end 70C of the separating member 68 is moved to approach toward (close to) the second developer roll 56 whose circumferential speed is relatively increased, that is, the leading end 70C of the separating member 68 is moved away from the first developer roll 52 whose circumferential speed is relatively decreased.

As describe above, even in a case in which the ratio of circumferential speeds of the first development roll 52 and the second development roll 56 is varied, the ratio of the amounts of the developer G adhering to the first development roll 52 and the developer G adhering to the second development roll 56 can be maintained in a proper state by the separating member 68 being rotated and moved, and even though the environment, passage of time, and/or use conditions change, an excellent image quality can be constantly maintained.

Further, the separating member 68 is configured so as to rotate and move around the shaft potion 72, and therefore, the separating member 68 moves by a simple structure.

Incidentally, the present invention is described above in detail with reference to a specific exemplary embodiment, but is not limited to such an exemplary embodiment and it is apparent to a person skilled in the art that other various exemplary embodiments are possible within the scope of the invention. For example, in the above-described exemplary embodiment, the transport pole N2 of the first development roll 52 and the opposing pole S6 of the second development roll 56 facing each other in the delivery portion 54 have different polarities, but the invention is not particularly limited to the same, these poles may have the same polarity.

Moreover, the above-described exemplary embodiment copes with changes of the development property caused by the environment, passage of time, use conditions and the like, by varying the circumferential speed of the first development roll 52, but the invention is not particularly limited to the same. The circumferential speed of the second development roll 56 may be varied or the circumferential speeds of both the first development roll 52 and the second development roll 56 may also be varied.

Next, one example of each of a developing device, an assembly body and an image forming apparatus according to a second exemplary embodiment of the present invention are described with reference to FIG. 6 and FIG. 7. Note that the same members as those of the first embodiment are denoted by the same reference numerals, and a description thereof is omitted.

Figure 6:
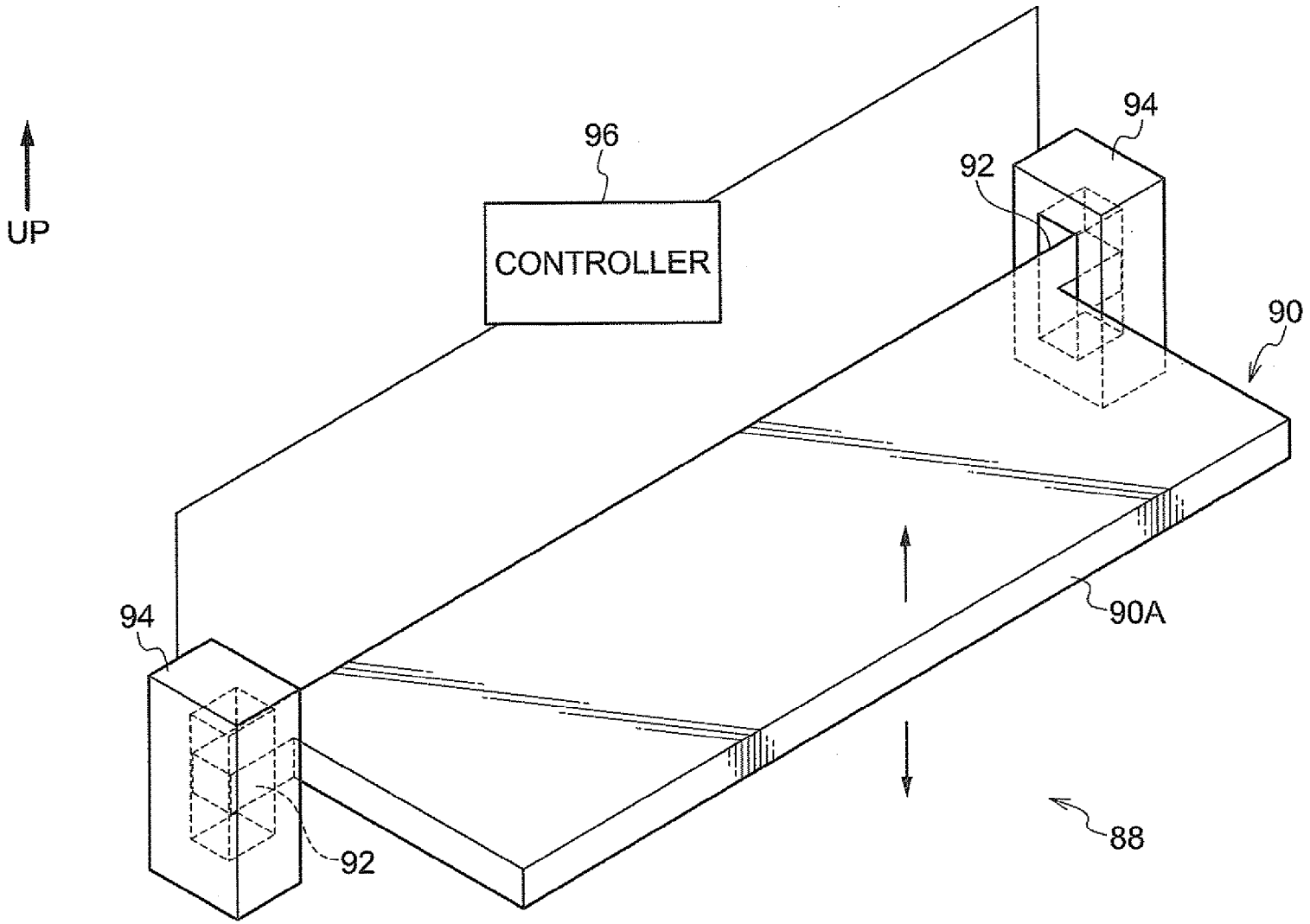
FIG. 6 is a perspective view showing a separating member and the like used in a developing device according to a second exemplary embodiment of the present invention.

As shown in FIG. 6, a separating member 88 of the second exemplary embodiment has a rectangular cross section, and includes a separating portion 90 which separates the developer G in such a manner that one end 90A thereof hits against the developer G, and a square pillar-shaped supporting portion 92 which supports the separating portion 90. The supporting portion 92 is provided so as to project from each of both end surfaces of the separating portion 90 in the longitudinal direction. The each end side of the supporting portion 92 is supported by a moving member 94 which is an example of a moving unit which moves up and down the supporting portion 92. Provided inside of the moving member 94 are a rail member which guides the supporting portion 92, a gear member which lifts up the supporting portion 92, and a stepping motor having a wire member wound on an output shaft (all of which are not shown) and the like.

Figure 7A:
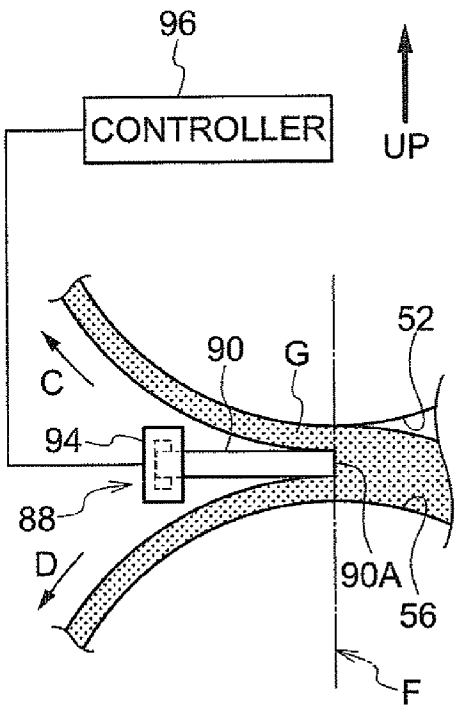
FIGS. 7A, 7B and 7C are side views each showing a separating member used in a developing device according to a second exemplary embodiment of the present invention.
Figure 7B:
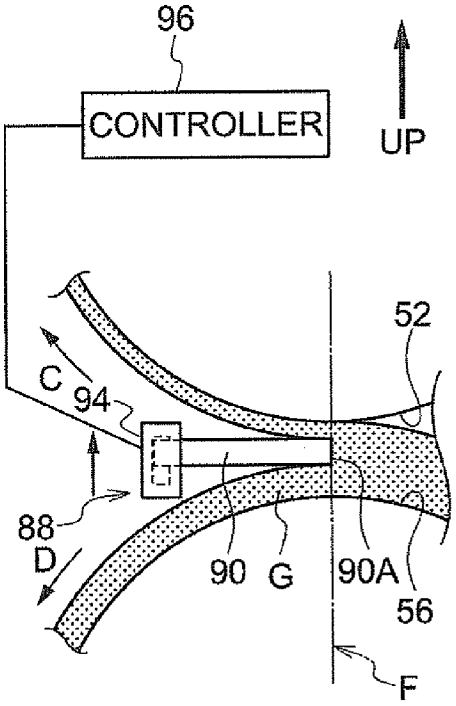
Figure 7C:
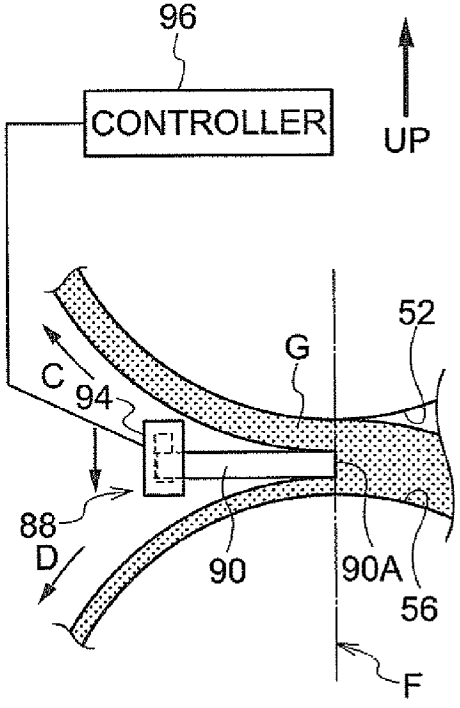

Furthermore, the moving member 94 is provided with a controller 96 which is an example of control unit which controls the moving member 94 to move up and down the separating member 88, so as to vary the separation ratio of the developer G. As shown in FIGS. 7A, 7B and 7C, due to control of the controller 96, the end 90A of the separating portion 90 which separates the developer G is supported so as to move along a straight line F which connects the rotating axis of the first development roll 52 and the rotating axis of the second development roll 56.

As described above, the end 90A of the separating portion 90 which separates the developer G moves along the straight lien F. In other words, the end 90A of the separating portion 90 moves along a magnetic line generated between the first development roll 52 and the second development roll 56, and therefore, even if the separating portion 90 moves to any positions, the sensitivities of the developer G formed on the first development roll 52 and the second development roll 56, and the end 90A become equal, and the control becomes facilitated.

What is claimed is:

1. A developing device comprising:

a first developer holding member that is disposed to face a surface of a latent image carrier that rotates, the first developer holding member rotating such that a moving direction of the first developer holding member is opposite to that of the latent image carrier at a portion where the latent image carrier and the first developer holding member face each other;

a second developer holding member that is provided at a downstream side of the first developer holding member in a direction in which the latent image carrier rotates, and is disposed to face the surface of the latent image carrier, the second developer holding member rotating such that a moving direction of the second developer holding member is the same as that of the latent image carrier at a portion where the latent image carrier and the second developer holding member face each other, and a ratio of circumferential speeds of the first developer holding member and the second developer holding member being variable;

a splitting member that splits developer for the first developer holding member and the second developer holding member at a position between the first developer holding member and the second developer holding member, by hitting against the developer located between a surface of the first developer holding member and a surface of the second developer holding member;

a moving unit that moves the splitting member; and a control unit that controls the moving unit to move the splitting member so as to vary a split ratio of the developer.

2. The developing device of claim 1, wherein the splitting member includes a split portion that hits against the developer to split the developer, and a shaft portion that supports the split portion rotatably at a downstream side in a direction in which the first developer holding member rotates.

3. The developing device of claim 1, wherein the splitting member is supported so as to move along a straight line connecting a rotating axis of the first developer holding member and a rotating axis of the second developer holding member.

4. The developing device of claim 1, wherein in a case in which the ratio of circumferential speeds of the first developer holding member and the second developer holding member is varied, the control unit controls so that a leading end portion of the splitting member which hits against the developer is moved close to one of the first developer holding member or the second developer holding member, whose circumferential speed is relatively increased.

5. The developing device of claim 1, wherein in a case in which the ratio of circumferential speeds of the first developer holding member and the second developer holding member is varied, the control unit controls so that a leading end portion of the splitting member which hits against the developer is moved away from one of the first developer holding member or the second developer holding member, whose circumferential speed is relatively decreased.

6. An assembly body comprising:

a latent image carrier that rotates and in which an electrostatic latent image formed on a surface thereof is made visible as a toner image; and the developing device including:

a first developer holding member that is disposed to face a surface of the latent image carrier, the first developer holding member rotating such that a moving direction of the first developer holding member is opposite to that of the latent image carrier at a portion where the latent image carrier and the first developer holding member face each other;

a second developer holding member that is provided at a downstream side of the first developer holding member in a direction in which the latent image carrier rotates, and is disposed to face the surface of the latent image carrier, the second developer holding member rotating such that a moving direction of the second developer holding member is the same as that of the latent image carrier at a portion where the latent image carrier and the second developer holding member face each other, and the ratio of circumferential speeds of the first developer holding member and the second, developer holding member being variable;

a splitting member that splits developer for the first developer holding member and the second developer holding member at a position between the first developer holding member and the second developer holding member, by hitting against the developer located between a surface of the first developer holding member and a surface of the second developer holding member;

a moving unit that moves the splitting member; and a control unit that controls the moving unit to move the splitting member so as to vary a split ratio of the developer, the developing device and the latent image carrier being assembled so as to be detachable with respect to a main body.

7. The assembly body of claim 6, wherein the splitting member includes a split portion that hits against the developer to split the developer, and a shaft portion that supports the split portion rotatably at a downstream side in a direction in which the first developer holding member rotates.

8. The assembly body of claim 6, wherein the splitting member is supported so as to move along a straight line connecting a rotating axis of the first developer holding member and a rotating axis of the second developer holding member.

9. The assembly body of claim 6, wherein in a case in which the ratio of circumferential speeds of the first developer holding member and the second developer holding member is varied, the control unit controls so that a leading end portion of the splitting member which hits against the developer is moved close to one of the first developer holding member or the second developer holding member, whose circumferential speed is relatively increased.

10. The assembly body of claim 6, wherein in a case in which the ratio of circumferential speeds of the first developer holding member and the second developer holding member is varied, the control unit controls so that a leading end portion of the splitting member which hits against the developer is moved away from one of the first developer holding member or the second developer holding member, whose circumferential speed is relatively decreased.

11. An image forming apparatus comprising:

an assembly body including:

a latent image carrier that rotates and in which an electrostatic latent image formed on a surface thereof is made visible as a toner image; and the developing device including:

a first developer holding member that is disposed to face a surface of the latent image carrier, the first developer holding member rotating such that a moving direction of the first developer holding member is opposite to that of the latent image carrier at a portion where the latent image carrier and the first developer holding member face each other;

a second developer holding member that is provided at a downstream side of the first developer holding member in a direction in which the latent image carrier rotates, and is disposed to face the surface of the latent image carrier, the second developer holding member rotating such that a moving direction of the second developer holding member is the same as that of the latent image carrier at a portion where the latent image carrier and the second developer holding member face each other, and the ratio of circumferential speeds of the first developer holding member and the second developer holding member being variable;

a splitting member that splits developer for the first developer holding member and the second developer holding member at a position between the first developer holding member and the second developer holding member, by hitting against the developer located between a surface of the first developer holding member and a surface of the second developer holding member;

a moving unit that moves the splitting member; and a control unit that controls the moving unit to move the splitting member so as to vary a split ratio of the developer, the developing device and the latent image carrier being assembled so as to be detachable with respect to a main body; and a transfer member that transfers, to a member to be transferred, the toner image formed on the surface of the latent image carrier provided in the assembly body.

12. The image forming apparatus of claim 11, wherein the splitting member includes a split portion that hits against the developer to split the developer, and a shaft portion that supports the split portion rotatably at a downstream side in a direction in which the first developer holding member rotates.

13. The image forming apparatus of claim 11, wherein the splitting member is supported so as to move along a straight line connecting a rotating axis of the first developer holding member and a rotating axis of the second developer holding member.

14. The image forming apparatus of claim 11, wherein in a case in which the ratio of circumferential speeds of the first developer holding member and the second developer holding member is varied, the control unit controls so that a leading end portion of the splitting member which hits against the developer is moved close to one of the first developer holding member or the second developer holding member, whose circumferential speed is relatively increased.

15. The image forming apparatus of claim 11, wherein in a case in which the ratio of circumferential speeds of the first developer holding member and the second developer holding member is varied, the control unit controls so that a leading end portion of the splitting member which hits against the developer is moved away from one of the first developer holding member or the second developer holding member, whose circumferential speed is relatively decreased.

16. An image forming apparatus comprising:

a latent image carrier that rotates and in which an electrostatic latent image formed on a surface thereof is made visible as a toner image;

the developing device including:

a first developer holding member that is disposed to face a surface of the latent image carrier, the first developer holding member rotating such that a moving direction of the first developer holding member is opposite to that of the latent image carrier at a portion where the latent image carrier and the first developer holding member face each other;

a second developer holding member that is provided at a downstream side of the first developer holding member in a direction in which the latent image carrier rotates, and is disposed to face the surface of the latent image carrier, the second developer holding member rotating such that a moving direction of the second developer holding member is the same as that of the latent image carrier at a portion where the latent image carrier and the second developer holding member face each other, and the ratio of circumferential speeds of the first developer holding member and the second developer holding member being variable;

a splitting member that splits developer for the first developer holding member and the second developer holding member at a position between the first developer holding member and the second developer holding member, by hitting against the developer located between a surface of the first developer holding member and a surface of the second developer holding member;

a moving unit that moves the splitting member; and a control unit that controls the moving unit to move the splitting member so as to vary a split ratio of the developer; and a transfer member that transfers, to a member to be transferred, the toner image formed on the surface of the latent image carrier.

17. The image forming apparatus claim 16, wherein the splitting member includes a split portion that hits against the developer to split the developer, and a shaft portion that supports the split portion rotatably at a downstream side in a direction in which the first developer holding member rotates.

18. The image forming apparatus claim 16, wherein the splitting member is supported so as to move along a straight line connecting a rotating axis of the first developer holding member and a rotating axis of the second developer holding member.

19. The image forming apparatus claim 16, wherein in a case in which the ratio of circumferential speeds of the first developer holding member and the second developer holding member is varied, the control unit controls so that a leading end portion of the splitting member which hits against the developer is moved close to one of the first developer holding member or the second developer holding member, whose circumferential speed is relatively increased.

20. The image forming apparatus claim 16, wherein in a case in which the ratio of circumferential speeds of the first developer holding member and the second developer holding member is varied, the control unit controls so that a leading end portion of the splitting member which hits against the developer is moved away from one of the first developer holding member or the second developer holding member, whose circumferential speed is relatively decreased.

* * * * *